US011104861B2

(12) United States Patent
Horita et al.

(10) Patent No.: US 11,104,861 B2
(45) Date of Patent: Aug. 31, 2021

(54) LUBRICATING OIL COMPOSITION FOR TWO WHEELED VEHICLE, METHOD FOR IMPROVING FUEL ECONOMY OF TWO WHEELED VEHICLE USING THE LUBRICATING OIL COMPOSITION, AND METHOD FOR PRODUCING THE LUBRICATING OIL COMPOSITION

(71) Applicant: IDEMITSU KOSAN CO., LTD., Chiyoda-ku (JP)

(72) Inventors: Naoto Horita, Funabashi (JP); Tsukasa Yamagishi, Chiba (JP); Moritsugu Kasai, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/498,181

(22) PCT Filed: Mar. 20, 2018

(86) PCT No.: PCT/JP2018/011021

§ 371 (c)(1),
(2) Date: Sep. 26, 2019

(87) PCT Pub. No.: WO2018/180763

PCT Pub. Date: Oct. 4, 2018

(65) Prior Publication Data

US 2020/0048576 A1 Feb. 13, 2020

(30) Foreign Application Priority Data

Mar. 30, 2017 (JP) ..... JP2017-069228

(51) Int. Cl.

| | |
|---|---|
| ***C10M 169/04*** | (2006.01) |
| ***C10M 129/50*** | (2006.01) |
| ***C10M 135/10*** | (2006.01) |
| ***C10M 141/08*** | (2006.01) |
| ***C10M 143/04*** | (2006.01) |

(Continued)

(52) U.S. Cl.

CPC ..... *C10M 169/044* (2013.01); *C10M 129/50* (2013.01); *C10M 135/10* (2013.01); *C10M 141/08* (2013.01); *C10M 143/04* (2013.01); *C10M 145/14* (2013.01); *C10M 157/00* (2013.01); *C10M 161/00* (2013.01); *C10M 2203/003* (2013.01); *C10M 2205/024* (2013.01); *C10M 2207/26* (2013.01); *C10M 2209/084* (2013.01); *C10M 2219/044* (2013.01); *C10M 2219/046* (2013.01); *C10N 2010/04* (2013.01); *C10N 2020/02* (2013.01); *C10N 2020/04* (2013.01); *C10N 2030/02* (2013.01); *C10N 2030/04* (2013.01); *C10N 2030/45* (2020.05); *C10N 2030/54* (2020.05); *C10N 2040/25* (2013.01)

(58) Field of Classification Search

CPC ..... C10M 169/04; C10M 169/044; C10M 145/14; C10M 157/00; C10M 161/00; C10M 2209/084; C10N 2020/04

See application file for complete search history.

(56) References Cited

U.S. PATENT DOCUMENTS 4,908,146 A * 3/1990 Smith, Jr. ..... C10M 161/00 508/506
5,217,636 A * 6/1993 Paboucek ..... C10M 145/14 508/473

(Continued)

FOREIGN PATENT DOCUMENTS

JP 2007-238944 A 9/2007
JP 2008-525583 A 7/2008

(Continued)

OTHER PUBLICATIONS

International Search Report dated May 29, 2018 in PCT/JP2018/011021 filed Mar. 20, 2018.

(Continued)

*Primary Examiner* — Ellen M McAvoy
(74) *Attorney, Agent, or Firm* — Oblon, McClelland, Maier & Neustadt, L.L.P.

(57) ABSTRACT

The present invention provides a lubricating oil composition for two-wheeled vehicles, which is able to not only suppress a lowering of fatigue life of engine parts while making fuel saving properties (in particular, fuel saving properties at the time of low speed) favorable but also make clutch friction characteristics of two-wheeled vehicles favorable. The present invention is concerned with a lubricating oil composition for two-wheeled vehicles, including a base oil (A) having a viscosity index of 120 or more, an ethylene-propylene copolymer (B), and a metal-based detergent (C), wherein the content of the ethylene-propylene copolymer (B) is 0.30% by mass or more on the basis of the whole amount of the lubricating oil composition; the metal-based detergent (C) contains a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is satisfied with a relation of ($1.0 \leq Ca_1/Ca_2$); and the lubricating oil composition has a kinematic viscosity at 100° C. is less than 9.3 $mm^2/s$ and an HTHS viscosity at 150° C. is 2.9 mPa·s or more.

18 Claims, No Drawings

(51) Int. Cl.

| | |
|---|---|
| ***C10M 145/14*** | (2006.01) |
| ***C10M 157/00*** | (2006.01) |
| ***C10M 161/00*** | (2006.01) |
| *C10N 10/04* | (2006.01) |
| *C10N 20/02* | (2006.01) |
| *C10N 20/04* | (2006.01) |
| *C10N 30/02* | (2006.01) |
| *C10N 30/04* | (2006.01) |
| *C10N 30/00* | (2006.01) |
| *C10N 40/25* | (2006.01) |

(56) References Cited

U.S. PATENT DOCUMENTS

| | | | | |
|---|---|---|---|---|
| 2011/0077183 | A1* | 3/2011 | Murata | C10M 157/00 508/473 |
| 2012/0132166 | A1 | 5/2012 | Andoh et al. | |
| 2013/0237465 | A1 | 9/2013 | Andoh et al. | |
| 2014/0051617 | A1* | 2/2014 | Wilkes | C10M 163/00 508/286 |
| 2016/0002563 | A1* | 1/2016 | Kasai | C10M 161/00 508/192 |
| 2016/0369201 | A1* | 12/2016 | Kasai | C10M 129/66 |
| 2017/0015926 | A1* | 1/2017 | Fletcher | C10M 159/24 |
| 2017/0175029 | A1 | 6/2017 | Watanabe | |
| 2017/0183601 | A1* | 6/2017 | Utaka | C10M 169/045 |
| 2017/0292083 | A1* | 10/2017 | Diegelmann | C10M 133/56 |
| 2017/0321146 | A1* | 11/2017 | Fletcher | C10M 137/10 |

FOREIGN PATENT DOCUMENTS

| | | | |
|---|---|---|---|
| JP | 2008-214641 | A | 9/2008 |
| JP | 2009-221382 | A | 10/2009 |
| JP | 2011-195734 | A | 10/2011 |
| JP | 2012-131986 | A | 7/2012 |
| JP | 2013-185087 | A | 9/2013 |
| JP | 2017-508053 | A | 3/2017 |
| WO | WO 2015/152143 | A1 | 10/2015 |

OTHER PUBLICATIONS

Japanese Office Action dated Jul. 7, 2020 in Patent Application No. 2017-069228 (with English translation), 5 pages.

Japanese Office Action dated Feb. 24, 2021 in Japanese Patent Application No. 2017-069228 (with English translation), citing documents AO and AP therein, 6 pages.

* cited by examiner

LUBRICATING OIL COMPOSITION FOR TWO WHEELED VEHICLE, METHOD FOR IMPROVING FUEL ECONOMY OF TWO WHEELED VEHICLE USING THE LUBRICATING OIL COMPOSITION, AND METHOD FOR PRODUCING THE LUBRICATING OIL COMPOSITION

TECHNICAL FIELD

The present invention relates to a lubricating oil composition for two-wheeled vehicles, a method for improving fuel consumption of two-wheeled vehicles using the lubricating oil composition, and a method of producing the lubricating oil composition.

BACKGROUND ART

In recent years, for the purpose of reducing an environmental load, an improvement of fuel saving properties is required for a lubricating oil composition for automobiles. As a general method of improvement of fuel saving properties, there is a method of subjecting a lubricating oil composition to viscosity reduction to decrease friction.

But, in merely subjecting the lubricating oil composition to viscosity reduction, there is a case where noise or vibration of an engine becomes large, an appropriate oil film is not held in a sliding part of an engine interior, or engine parts are damaged due to fatigue or wear.

As a method for solving such a problem, the technologies of PTLs 1 and 2 are proposed.

CITATION LIST

Patent Literature

PTL 1: JP 2009-221382 A
PTL 2: JP 2011-195734 A

SUMMARY OF INVENTION

Technical Problem

In PTL 1, as a problem of providing a lubricating oil composition having excellent fuel saving properties and capable of suppressing generation of noise and vibration, there is proposed a lubricating oil composition containing a specified base oil and (a) an ethylene-α-olefin copolymer having a number average molecular weight of 2,500 to 25,000 and/or (b) a polymethacrylate having a number average molecular weight of 10,000 to 30,000.

However, PTL 1 does not at all investigate pitting that becomes a problem especially in two-wheeled vehicles (pitting=a phenomenon in which a crankshaft, a gear, or the like is damaged due to fatigue; generation of pitting means that a fatigue life of engine parts is lowered).

In PTL 2, as a problem of providing a lubricant oil composition for internal combustion engines which can, despite of its low viscosity, reduce noise during running, prevent fatigue damage, such as gear pitting, reduce the consumption of the oil, and provide excellent fuel saving properties, there is proposed a lubricant oil composition for internal combustion engines containing a specified base oil and (A) an olefin polymer having 2 to 20 carbon atoms and having a mass average molecular weight of 500 or more and 10,000 or less and/or (B) a polymer compound having a mass average molecular weight of 10,000 or more and less than 100,000.

PTL 2 investigates suppression of a lowering of fatigue life of engine parts, an issue of which becomes a problem especially in two-wheeled vehicles. However, in the case where the viscosity of the lubricating oil composition for two-wheeled vehicles is lowered, nevertheless there is involved such a problem that in addition to the problem regarding the fatigue of engine parts, clutch friction characteristics cannot be satisfied, PTL 2 does not all investigate the clutch friction characteristics. Furthermore, PTLs 1 and 2 do not at all investigate an improvement of fuel saving properties at the time of low speed.

An object of the present invention is to provide a lubricating oil composition for two-wheeled vehicles, which is able to not only suppress a lowering of fatigue life of engine parts while making fuel saving properties (in particular, fuel saving properties at the time of low speed at which a boundary lubrication area is liable to be formed) favorable but also make clutch friction characteristics of two-wheeled vehicles favorable. Another object of the present invention is to provide a method for improving fuel consumption of two-wheeled vehicles using the lubricating oil composition and a method of producing the lubricating oil composition.

Solution to Problem

The present invention provides a lubricating oil composition for two-wheeled vehicles, a method for improving fuel consumption of two-wheeled vehicles using the lubricating oil composition, and a method of producing the lubricating oil composition as mentioned below.

[1] A lubricating oil composition for two-wheeled vehicles, including a base oil (A) having a viscosity index of 120 or more, an ethylene-propylene copolymer (B), and a metal-based detergent (C), wherein the content of the ethylene-propylene copolymer (B) is 0.30% by mass or more on the basis of the whole amount of the lubricating oil composition; the metal-based detergent (C) contains a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is satisfied with a relation of ($1.0 \leq Ca_1/Ca_2$); and the lubricating oil composition has a kinematic viscosity at 100° C. of less than 9.3 $mm^2/s$ and an HTHS viscosity at 150° C. of 2.9 mPa·s or more.

[2] A method for improving fuel consumption of two-wheeled vehicles, including adding the lubricating oil composition for two-wheeled vehicles as set forth in the above [1] to a two-wheeled vehicle engine.

[3] A method of producing a lubricating oil composition for two-wheeled vehicles, including a step of preparing a lubricating oil composition containing a base oil (A) having a viscosity index of 120 or more, an ethylene-propylene copolymer (B), and a metal-based detergent (C), wherein the preparation is performed so as to satisfy the following requirements (i) to (iv):

(i) the content of the ethylene-propylene copolymer (B) is 0.30% by mass or more on the basis of the whole amount of the lubricating oil composition;

(ii) the metal-based detergent (C) contains a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is ($1.0 \leq Ca_1/Ca_2$);

(iii) a kinematic viscosity at 100° C. of the lubricating oil composition is less than 9.3 $mm^2/s$; and (iv) an HTHS viscosity at 150° C. of the lubricating oil composition is 2.9 mPa·s or more.

Advantageous Effects of Invention

In accordance with the lubricating oil composition for two-wheeled vehicles of the present invention, it is possible to not only suppress a lowering of fatigue life of engine parts while making fuel saving properties favorable but also make clutch friction characteristics of two-wheeled vehicles favorable.

DESCRIPTION OF EMBODIMENTS

Embodiments of the present invention are hereunder described.

[Lubricating Oil Composition for Two-Wheeled Vehicles]

The lubricating oil composition for two-wheeled vehicles of the present embodiment is one including a base oil (A) having a viscosity index of 120 or more, an ethylene-propylene copolymer (B), and a metal-based detergent (C), wherein the content of the ethylene-propylene copolymer (B) is 0.30% by mass or more on the basis of the whole amount of the lubricating oil composition; the metal-based detergent (C) contains a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is satisfied with a relation of ($1.0 \leq Ca_1/Ca_2$); and the lubricating oil composition has a kinematic viscosity at 100° C. of less than 9.3 $mm^2/s$ and an HTHS viscosity at 150° C. of 2.9 mPa·s or more.

The lubricating oil composition for two-wheeled vehicles is hereunder occasionally abbreviated as "lubricating oil composition".

<Base Oil (A)>

The base oil (A) is not particularly limited so long as it has a viscosity index of 120 or more, and a mineral oil, a synthetic oil, and a mixture of a mineral oil and a synthetic oil can be used.

In the case where the viscosity index of the base oil (A) is less than 120, the viscosity of the lubricating oil composition at the time of high temperature is lowered, whereby the friction increases, so that it becomes difficult to satisfy the fuel saving properties.

The viscosity index of the base oil (A) is preferably 122 or more, more preferably 123 or more, and still more preferably 125 or more.

Examples of the mineral oil include a paraffin-based mineral oil, an intermediate-based mineral oil, and a naphthene-based mineral oil, which are obtained by an ordinary refining method, such as solvent refining and hydrogenation refining; and a wax isomerized oil, which is produced through isomerization of a wax, such as a wax produced by the Fischer-Tropsch process or the like (gas-to-liquid wax), and a mineral oil wax.

Examples of the synthetic oil include a hydrocarbon-based synthetic oil and an ether-based synthetic oil. Examples of the hydrocarbon-based synthetic oil include an alkylbenzene and an alkylnaphthalene. Examples of the ether-based synthetic oil include a polyoxyalkylene glycol and a polyphenyl ether.

Of these, from the viewpoint of fuel saving properties and an improvement of cold startability of engine, the base oil is preferably at least one selected from mineral oils and synthetic oils classified into Groups 3 to 5 of the base stock categories of the API (American Petroleum Institute).

The base oil (A) may be a single component system using one of the aforementioned mineral oils and synthetic oils, or may be a mixed system obtained by mixing two or more of the mineral oils, mixing two or more of the synthetic oils, or mixing one or two or more of each of the mineral oils and the synthetic oils.

From the viewpoint of a balance between fuel saving properties and an evaporation loss, the kinematic viscosity at 100° C. of the base oil (A) is preferably 2 to 20 $mm^2/s$, more preferably 2 to 15 $mm^2/s$, and still more preferably 3 to 10 $mm^2/s$.

In the case where the base oil (A) is a base oil obtained by mixing two or more base oils, it is preferred that the kinematic viscosity of the mixed base oil is satisfied with the aforementioned range.

In the present embodiment, the kinematic viscosity of the base oil (A) or the like can be measured in conformity with JIS K2283:2000.

The content ratio of the base oil (A) is preferably 70 to 95% by mass, more preferably 75 to 93% by mass, and still more preferably 80 to 90% by mass on the basis of the whole amount of the lubricating oil composition.

<Ethylene-Propylene Copolymer (B)>

The lubricating oil composition of the present embodiment contains the ethylene-propylene copolymer (B) in an amount of 0.30% by mass or more on the basis of the whole amount of the lubricating oil composition.

In the case where the content of the ethylene-propylene copolymer (B) is less than 0.30% by mass on the basis of the whole amount of the lubricating oil composition, an appropriate oil film is not held in a sliding part of an engine interior, the lowering of fatigue life of engine parts cannot be suppressed, and furthermore, the fuel saving properties cannot be satisfied. In particular, at the time of low speed at which a boundary lubrication area is liable to be formed, the aforementioned problems are liable to be generated.

When the content of the ethylene-propylene copolymer (B) is in excess, there is a tendency that the viscosity in a low-temperature environment increases, whereby the cold startability of engine is worsened. For this reason, the content of the ethylene-propylene copolymer (B) is preferably 0.30% by mass or more and 3.00% by mass or less, more preferably 0.50% by mass or more and 2.00% by mass or less, and still more preferably 0.80% by mass or more and 1.50% by mass or less on the basis of the whole amount of the lubricating oil composition.

The mass average molecular weight (Mw) of the ethylene-propylene copolymer (B) is preferably 30,000 or less.

By regulating the mass average molecular weight (Mw) of the ethylene-propylene copolymer (B) to 30,000 or less, the lowering of fatigue life of engine parts is readily suppressed, and furthermore, the fuel saving properties can be readily made favorable. When the mass average molecular weight (Mw) of the ethylene-propylene copolymer (B) is too low, an appropriate oil film is hardly held in a sliding part of an engine interior. For this reason, the mass average molecular weight (Mw) of the ethylene-propylene copolymer (B) is more preferably 8,000 or more and 25,000 or less, and still more preferably 11,000 or more and 20,000 or less.

In this specification, the mass average molecular weight is a value calculated by performing the measurement through gel permeation chromatography and expressing the measured value in terms of polystyrene.

The kinematic viscosity at 100° C. of the ethylene-propylene copolymer (B) is preferably 750 $mm^2/s$ or more and 2,500 $mm^2/s$ or less, more preferably 850 $mm^2/s$ or more and 2,300 $mm^2/s$ or less, and still more preferably 1,000 $mm^2/s$ or more and 2,100 $mm^2/s$ or less.

By regulating the kinematic viscosity at 100° C. of the ethylene-propylene copolymer (B) to 750 $mm^2/s$ or more, it is possible to readily hold an appropriate oil film in a sliding part of an engine interior, and by regulating the kinematic viscosity at 100° C. to 2,500 $mm^2/s$ or less, it is possible to readily make the fuel saving properties favorable.

The ethylene-propylene copolymer (B) can be produced by an arbitrary method. For example, the ethylene-propylene copolymer (B) can be produced through a thermal reaction in the absence of a catalyst. In addition to that, the ethylene-propylene copolymer (B) can be produced by copolymerizing ethylene and propylene using a known catalyst system, such as an organic peroxide catalyst, e.g., benzoyl peroxide; a Friedel-Crafts type catalyst, e.g., aluminum chloride, an aluminum chloride-polyhydric alcohol system, an aluminum chloride-titanium tetrachloride system, an aluminum chloride-alkyltin halide system, and boron fluoride; a Ziegler type catalyst, e.g., an organic aluminum chloride-titanium tetrachloride system and an organoaluminum-titanium tetrachloride system; a metallocene type catalyst, e.g., an aluminoxane-zirconocene system and an ionic compound-zirconocene system; and a Lewis acid complex type catalyst, e.g., an aluminum chloride-base system and a boron fluoride-base system. Though the ratio of ethylene is not particularly limited, it is preferably 15 to 80% by mol.

The ethylene-propylene copolymer (B) may be either a random copolymer or a block copolymer.

<Metal-Based Detergent (C)>

The lubricating oil composition of the present embodiment contains, as the metal-based detergent (C), a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is required to satisfy a relation of ($1.0 \leq Ca_1/Ca_2$).

In the case where the $Ca_1/Ca_2$ is less than 1.0, the clutch friction characteristics of two-wheeled vehicles cannot be made favorable. Specifically, in the case where the $Ca_1/Ca_2$ is less than 1.0, friction characteristics satisfying MA or more (MA1 or MA2) of JASO T903:2011 cannot be obtained, and clutch operability is lowered due to, for example, the generation of a state in which the clutch slips.

The $Ca_1/Ca_2$ is preferably 1.5 or more, more preferably 2.0 or more, and still more preferably 3.0 or more.

When the $Ca_1/Ca_2$ is excessively large, the detergency is liable to be lowered. For this reason, the $Ca_1/Ca_2$ is preferably 7.0 or less, more preferably 6.0 or less, and still more preferably 5.0 or less.

In the present embodiment, the calcium content can be measured in conformity with JIS-5S-38-92.

Examples of the calcium phenate (C1) include calcium salts of an alkylphenol, an alkylphenol sulfide, and a Mannich reaction product of an alkylphenol. The alkyl group is preferably one having 4 to 30 carbon atoms, and more preferably one having 10 to 26 carbon atoms, and the alkyl group may be either linear or branched. Such an alkyl group may be a primary alkyl group, a secondary alkyl group, or a tertiary alkyl group.

Examples of the calcium phenate (C1) include a neutral calcium phenate, a basic calcium phenate, and an overbased calcium phenate. Of these, an overbased calcium phenate is suitable.

In the case where the calcium phenate (C1) is an overbased calcium phenate, its total base number is preferably 150 mgKOH/g or more, more preferably 150 to 500 mgKOH/g, and still more preferably 150 to 450 mgKOH/g.

Examples of the calcium sulfonate (C2) include calcium salts of an alkyl aromatic sulfonic acid obtained through sulfonation of an alkyl aromatic compound having a mass average molecular weight of preferably 300 to 1,500, and more preferably 400 to 700. The alkyl group is preferably one having 4 to 30 carbon atoms, and more preferably one having 10 to 26 carbon atoms, and the alkyl group may be either linear or branched. Such an alkyl group may be a primary alkyl group, a secondary alkyl group, or a tertiary alkyl group.

Examples of the calcium sulfonate (C2) include a neutral calcium sulfonate, a basic calcium sulfonate, and an overbased calcium sulfonate. In the present embodiment, it is preferred to use a combination of a neutral calcium sulfonate and an overbased calcium sulfonate.

In the case where the calcium sulfonate (C2) is an overbased calcium sulfonate, its total base number is preferably 150 mgKOH/g or more, more preferably 150 to 500 mgKOH/g, and still more preferably 150 to 450 mgKOH/g.

In the case where the calcium sulfonate (C2) is a neutral calcium sulfonate, its total base number is preferably 80 mgKOH/g or less, more preferably 5 to 50 mgKOH/g, and still more preferably 10 to 30 mgKOH/g.

In the case where the calcium sulfonate (C2) is a combination of a neutral calcium sulfonate and an overbased calcium sulfonate, a ratio of the calcium amount derived from the neutral calcium sulfonate to the calcium amount derived from the overbased calcium sulfonate [(calcium amount derived from neutral calcium sulfonate)/(calcium amount derived from overbased calcium sulfonate)] is preferably 0.20 or more and less than 1.00, more preferably 0.30 or more and 0.80 or less, and still more preferably 0.40 or more and 0.70 or less.

The calcium phenate (C1) is preferably one having a molecular weight of 300 to 1,500, and more preferably one having a molecular weight of 400 to 700.

The calcium sulfonate (C2) is preferably one having a molecular weight of 300 to 1,500, and more preferably one having a molecular weight of 400 to 700.

The lubricating oil composition of the present embodiment may contain a metal-based detergent other than the calcium phenate (C1) and the calcium sulfonate (C2) within a range where the effects of the present invention are not impaired. Examples of the metal-based detergent other than the calcium phenate (C1) and the calcium sulfonate (C2) include calcium salicylate, magnesium phenate, magnesium sulfonate, magnesium salicylate, sodium phenate, sodium sulfonate, and sodium salicylate.

From the viewpoint of suppressing the formation of a deposit in an engine interior as well as the viewpoint of suppressing a sulfated ash content, the content of the metal-based detergent (C) as expressed in terms of a metal atom is preferably more than 0.12% by mass and 0.22% by mass or less, more preferably more than 0.14% by mass and 0.21% by mass or less, and still more preferably more than 0.15% by mass and 0.20% by mass or less on the basis of the whole amount of the lubricating oil composition.

The content ($Ca_1$) of the calcium phenate (C1) as expressed in terms of a calcium atom is preferably 0.10% by mass or more and 0.20% by mass or less, more preferably 0.12% by mass or more and 0.18% by mass or less, and still more preferably 0.12% by mass or more and 0.16% by mass or less on the basis of the whole amount of the lubricating oil composition.

By regulating the $Ca_1$ to 0.10% by mass or more on the basis of the whole amount of the lubricating oil composition, it is possible to readily make the clutch friction characteristics of two-wheeled vehicles favorable, and by regulating the $Ca_1$ to 0.20% by mass or less, it is possible to suppress the sulfated ash content.

<Viscosity Index Improver (D)>

In order to readily hold an oil film in a high-temperature region, it is preferred that the lubricating oil composition of the present embodiment further contains a viscosity index improver (D) having a mass average molecular weight of 100,000 or more. In addition, by containing the viscosity index improver (D) having a mass average molecular weight of 100,000 or more, it is possible to readily regulate an HTHS viscosity at 150° C. of the lubricating oil composition to 2.9 mPa·s or more.

The mass average molecular weight of the viscosity index improver (D) is more preferably 100,000 or more and 500,000 or less, and still more preferably 200,000 or more and 400,000 or less.

Examples of the viscosity index improver (D) include resins, such as poly(meth)acrylate-based resins (for example, a polyalkyl methacrylate and a polyalkyl acrylate), olefin copolymer-based resins (for example, an ethylene-propylene copolymer and a polybutylene), styrene-based copolymers (for example, a polyalkylstyrene, a styrene-diene copolymer, a styrene-diene hydrogenated copolymer, and a styrene-maleic anhydride ester copolymer). Of these, poly(meth)acrylate-based resins are suitable.

The structure of the viscosity index improver may be either linear or branched. In addition, the viscosity index improver may be a polymer having a specified structure, such as a comb-type polymer having a structure having a large number of trigeminal branch points from which a high-molecular weight side chain comes out in a main chain thereof; and a star-shaped polymer which is a kind of branched polymer and has a structure in which three or more chain polymers are bonded at one point.

The monomer that constitutes the polyalkyl (meth)acrylate is an alkyl (meth)acrylate, and preferably an alkyl (meth)acrylate of a linear alkyl group having 1 to 18 carbon atoms or a branched alkyl group having 3 to 34 carbon atoms.

Preferred examples of the monomer that constitutes the alkyl (meth)acrylate include methyl (meth) acrylate, ethyl (meth)acrylate, propyl (meth)acrylate, butyl (meth)acrylate, pentyl (meth)acrylate, hexyl (meth)acrylate, hexyl (meth) acrylate, heptyl (meth)acrylate, octyl (meth)acrylate, nonyl (meth)acrylate, decyl (meth)acrylate, dodecyl (meth)acrylate, tetra(meth)acrylate, hexa(meth)acrylate, and octadecyl (meth)acrylate. The alkyl (meth)acrylate may be a copolymer obtained by using two or more of these monomers. The alkyl group of such a monomer may be either linear or branched.

Examples of the alkyl (meth)acrylate having a branched alkyl group having 3 to 34 carbon atoms include isopropyl (meth)acrylate, 2-ethylhexyl (meth)acrylate, 3,5,5-trimethylhexyl (meth)acrylate, 2-butyloctyl (meth)acrylate, 2-hexyldecyl (meth)acrylate, 2-octyldodecyl (meth)acrylate, 2-decyltetradecyl (meth)acrylate, 2-dodecylhexadecyl (meth)acrylate, and 2-tetradecyloctadecyl (meth)acrylate.

The content of the viscosity index improver (D) is preferably 1.0 to 8.0% by mass, more preferably 1.2 to 6.0% by mass, still more preferably 1.5 to 4.0% by mass, and yet still more preferably 1.5 to 3.0% by mass on the basis of the whole amount of the lubricating oil composition.

By regulating the content of the viscosity index improver (D) to 1.0% by mass or more, it is possible to readily hold an oil film in a high-temperature region, and by regulating the content of the viscosity index improver (D) to 8.0% by mass or less, it is possible to suppress an excessive increase of the viscosity.

Though the viscosity index improver (D) is frequently marketed in a solution state in which the resin as a main component is diluted with a diluent oil, such as a mineral oil, it should be construed that the content of the viscosity index improver (D) refers to the resin content from which a diluent liquid and so on are excluded.

From the viewpoint of a balance between the cold startability of engine and the fuel saving properties at the time of low speed, the content of the viscosity index improver (D) is preferably 90 parts by mass or more and 500 parts by mass or less, more preferably 150 parts by mass or more and 450 parts by mass or less, and still more preferably 150 parts by mass or more and 250 parts by mass or less based on 100 parts by mass of the ethylene-propylene copolymer (B).

<Ash-Free Friction Modifier (E)>

It is preferred that the lubricating oil composition of the present embodiment further contains an ash-free friction modifier (E).

Typically, when the ash-free friction modifier (E) is contained, the clutch friction characteristics are lowered. However, as for the lubricating oil composition of the present embodiment, by regulating the $Ca_1/Ca_2$ to 1.0 or more, even when it contains the ash-free friction modifier (E), a lowering of the clutch friction characteristics can be suppressed. That is, even when the lubricating oil composition of the present embodiment contains the ash-free friction modifier (E), a lowering of the clutch friction characteristics can be suppressed, and therefore, it is useful from the standpoint that both the fuel saving properties due to friction reduction and the clutch friction characteristics can be made compatible with each other.

Examples of the ash-free friction modifier (E) include an ester-based compound, an amine-based compound, and an amide-based compound.

Specific examples of the ash-free friction modifier (E) include glycerin fatty acid monoesters, such as glycerin monolaurate, glycerin monostearate, glycerin monomyristate, and glycerin monooleate; amide compounds having two 2-hydroxyalkyl groups, such as octyl diethanolamide, decyl diethanolamide, dodecyl diethanolamide, tetradecyl diethanolamide, hexadecyl diethanolamide, stearyl diethanolamide, oleyl diethanolamide, coconut oil diethanolamide, palm oil diethanolamide, rapeseed oil diethanolamide, and beef tallow diethanolamide; and amide compounds having two polyalkylene oxide structures, such as polyoxyethylene octylamide, polyoxyethylene decylamide, polyoxyethylene do decylamide, polyoxyethylene tetradecylamide, polyoxyethylene hexadecylamide, polyoxyethylene stearylamide, polyoxyethylene oleylamide, polyoxyethylene beef tallow amide, polyoxyethylene coconut oil amide, polyoxyethylene palm oil amide, polyoxyethylene laurylamide, polyoxyethylene stearylamide, polyoxyethylene oleylamide, and ethylene oxide propylene oxide stearylamide.

From the viewpoint of a balance between the fuel saving properties and the clutch friction characteristics, the content of the ash-free friction modifier (E) is preferably 0.1 to 1.0% by mass, more preferably 0.2 to 0.8% by mass, and still more preferably 0.3 to 0.7% by mass on the basis of the whole amount of the lubricating oil composition.

<Additives>

The lubricating oil composition of the present embodiment may further contain at least one general-purpose additive selected from a detergent dispersant, a pour-point depressant, an anti-wear agent, and an antioxidant.

The content of each of these additives can be properly adjusted, and it is typically 0.001 to 10% by mass, and preferably 0.005 to 5% by mass on the basis of the whole amount of the composition. In addition, the total content of these additives is preferably 20% by mass or less, more preferably 10% by mass or less, still more preferably 5% by mass or less, and yet still more preferably 2% by mass or less on the basis of the whole amount of the composition.

<Properties of Lubricating Oil Composition>

The lubricating oil composition of the present invention is required to have a kinematic viscosity at 100° C. of less than 9.3 $mm^2/s$. In the case where the kinematic viscosity at 100° C. of the lubricating oil composition is 9.3 $mm^2/s$ or more, the fuel saving properties cannot be made favorable.

In the case where the kinematic viscosity at 100° C. of the lubricating oil composition is too low, there is a tendency that the lubricating oil composition is liable to be evaporated. For this reason, the kinematic viscosity at 100° C. of the lubricating oil composition is more preferably 5.0 $mm^2/s$ or more and less than 9.3 $mm^2/s$, and still more preferably 7.0 $mm^2/s$ or more and 9.2 $mm^2/s$ or less.

In the present embodiment, the kinematic viscosity at 40° C. of the lubricating oil composition is preferably 35.0 to 45.0 $mm^2/s$, more preferably 36.0 to 44.0 $mm^2/s$, and still more preferably 38.0 to 42.0 $mm^2/s$.

In the present embodiment, the viscosity index of the lubricating oil composition is preferably 145 or more, more preferably 150 or more, and still more preferably 155 or more.

The lubricating oil composition of the present embodiment is required to have an HTHS viscosity at 150° C. of 2.9 mPa·s or more.

In the case where the HTHS viscosity at 150° C. is less than 2.9 mPa·s, an oil film in a high-temperature region assuming the time of high-speed operation of engine cannot be held, and it becomes difficult to suppress a lowering of fatigue life of engine parts. Furthermore, the physicochemical properties stipulated in JASO T903:2011 cannot be satisfied, too.

In the case where the HTHS viscosity at 150° C. is excessively high, the fuel saving properties are hardly satisfied. For this reason, the HTHS viscosity at 150° C. of the lubricating oil composition is preferably 2.9 mPa·s or more and 3.2 mPa·s or less, more preferably 2.9 mPa·s or more and 3.1 mPa·s or less, and still more preferably 2.9 mPa·s or more and 3.0 mPa·s or less.

In the lubricating oil composition of the present embodiment, its HTHS viscosity at 100° C. is preferably 4.0 mPa·s or more and 7.0 mPa·s or less, more preferably 4.5 mPa·s or more and 6.5 mPa·s or less, and still more preferably 5.0 mPa·s or more and 6.0 mPa·s or less.

The HTHS viscosity at 150° C. or 100° C. is a value of a high temperature high shear viscosity at 150° C. or 100° C. as measured in conformity with JPI-5S-36-03, and specifically, it is a value obtained by the measurement method described in the section of Examples.

In the lubricating oil composition of the present embodiment, from the viewpoint of improving the fuel saving properties at the time of high-speed operation, its CCS viscosity at −35° C. is preferably 13,000 mPa·s or less, more preferably 10,000 mPa·s or less, and still more preferably 6,000 mPa·s or less.

The CCS viscosity at −35° C. can be measured in conformity with JIS K2010:1993.

In the lubricating oil composition of the present embodiment, its sulfated ash content is preferably 0.9% by mass or less, and more preferably 0.8% by mass or less.

By regulating the sulfated ash content of the lubricating oil composition to 0.9% by mass or less, the amount of a deposit on the occasion when the lubricating oil composition is degraded can be decreased, and the wear of the engine member can be readily suppressed.

The sulfated ash content of the lubricating oil composition can be measured in conformity with JIS K2272:1998.

From the viewpoint of fuel saving properties, it is preferred that the lubricating oil composition of the present embodiment has a viscosity of xW-20 to xW-8 in terms of the classification according to SAE J300:2015. "x" is 0, 5, or 10.

Specifically, it is preferred that the lubricating oil composition of the present embodiment is classified in any one of 0W-20, 0W-16, 0W-12, 0W-8, 5W-20, 5W-16, 5W-12, 5W-8, 10W-20, 10W-16, 10W-12, and 10W-8 in the classification according to SAE J300:2015.

The lubricating oil composition of the present embodiment is used as a lubricating oil composition for two-wheeled vehicles, and in particular, it is suitably used as a lubricating oil composition for two-wheeled vehicle engines. In addition, the lubricating oil composition of the present embodiment is suitably used as a lubricating oil composition for four-stroke engines among two-wheeled vehicle engines.

<Method for Improving Fuel Consumption of Two-Wheeled Vehicles>

The method for improving fuel consumption of two-wheeled vehicles of the present embodiment is a method of adding the lubricating oil composition for two-wheeled vehicles of the present embodiment as mentioned above to a two-wheeled vehicle engine.

In accordance with the method for improving fuel consumption of two-wheeled vehicles of the present embodiment, it is able to not only suppress a lowering of fatigue life of engine parts while making fuel saving properties (in particular, fuel saving properties at the time of low speed at which a boundary lubrication area is liable to be formed) favorable but also make clutch friction characteristics of two-wheeled vehicles favorable. In particular, there is exhibited a favorable effect against four-stroke engines of two-wheeled vehicle.

<Method of Producing Lubricating Oil Composition for Two-Wheeled Vehicles>

The method of producing a lubricating oil composition for two-wheeled vehicles of the present embodiment is a method of producing a lubricating oil composition for two-wheeled vehicles, including a step of preparing a lubricating oil composition containing a base oil (A) having a viscosity index of 120 or more, an ethylene-propylene copolymer (B), and a metal-based detergent (C), wherein the preparation is performed so as to satisfy the following requirements (i) to (iv);

(i) the content of the ethylene-propylene copolymer (B) is 0.30% by mass or more on the basis of the whole amount of the lubricating oil composition;

(ii) the metal-based detergent (C) contains a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is ($1.0\ Ca_1/Ca_2$);

(iii) a kinematic viscosity at 100° C. of the lubricating oil composition is less than 9.3 $mm^2/s$; and (iv) an HTHS viscosity at 150° C. of the lubricating oil composition is 2.9 mPa·s or more.

In the aforementioned mixing step, after mixing the ethylene-propylene copolymer (B) and the metal-based detergent (C), the mixture may be added to the base oil (A), or the ethylene-propylene copolymer (B) and the metal-based detergent (C) may be separately added to the base oil (A).

In the method of producing a lubricating oil composition for two-wheeled vehicles of the present embodiment, it is preferred to perform the aforementioned step so as to satisfy the suitable embodiment of the lubricating oil composition for two-wheeled vehicles of the present embodiment as mentioned above.

For example, it is preferred to perform the aforementioned step such that the content ($Ca_1$) of the calcium phenate (C1) as expressed in terms of a calcium atom is 0.10% by mass or more and 0.20% by mass or less on the basis of the whole amount of the lubricating oil composition. In addition, in the step of preparing the lubricating oil composition, it is preferred to perform the step such that the lubricating oil composition further contains the viscosity index improver (D) having a mass average molecular weight of 100,000 or more.

In accordance with the method of producing a lubricating oil composition for two-wheeled vehicles of the present embodiment, the lubricating oil composition which is able to not only suppress a lowering of fatigue life of engine parts while making fuel saving properties (in particular, fuel saving properties at the time of low speed at which a boundary lubrication area is liable to be formed) favorable but also make clutch friction characteristics of two-wheeled vehicles favorable can be easily produced.

EXAMPLES

Next, the present embodiments are more specifically described by reference to Examples.

1. Measurement 1-1. Kinematic Viscosity

The kinematic viscosity at 100° C. of each of the base oil (A) and the lubricating oil composition was measured in conformity with JIS K2283:2000. In addition, the viscosity index of the base oil (A) was calculated.

1-2. HTHS Viscosity

The HTHS viscosity at each of oil temperatures of 100° C. and 150° C. was measured with a TBS viscometer (tapered bearing simulator viscometer) under a condition at a shear rate of $10^6/s$ and a rotation number (motor) of 3,000 rpm with a distance (rotor-stator distance) of 3 μm in conformity with JPI-5S-36-03.

1-3. CCS Viscosity

The CCS viscosity at −35° C. of the lubricating oil composition was measured in conformity with JIS K2010: 1993.

1-4. Calcium Content

The calcium content of the lubricating oil composition was measured in conformity with JIS-5S-38-92.

1-5. Sulfated Ash Content

The sulfated ash content of the lubricating oil composition was measured in conformity with JIS K2272:1998.

1-6. SAE Standard

The viscosity grade of the lubricating oil composition was classified on the basis of the standard (SAE Standard) regarding the viscosity of lubricating oil stipulated by the Society of Automotive Engineers. The numeral before "W" expresses a viscosity on the low-temperature side, and the numeral after "hyphen" expresses a viscosity on the high-temperature side.

2. Evaluation 2-1. Clutch Friction Characteristics

The grade of the clutch friction characteristics of the lubricating oil composition was classified under the following test condition in conformity with the clutch friction characteristics evaluation test method described in JASO T903:2011. "MA", "MA1", and "MA2" each indicate that the clutch friction characteristics are a favorable grade, and "MA2" indicates that the clutch friction characteristics are a best grade.

<Test Condition>

Tester: SAE No. 2 tester (manufactured by Automax Co., Ltd.)

Dynamic friction test: In conformity with JASO M348, 3.3.1

Static friction test: In conformity with JASO M348, 3.3.2

Test cycle: 1,000 times

Evaluation method: Classified into grades of MB, MA, MA1, and MA2, respectively in conformity with JASO T903:2011. A lubricating oil composition not satisfying the physicochemical properties stipulated in JASO T903:2011 was designated as "nonstandard".

1: For "MA1", those having a dynamic friction characteristic index of 1.30 or more and less than 1.85, a static friction characteristic index of 1.25 or more and less than 1.70, and a stop time index of 1.45 or more and less than 1.85 are classified. For "MA2", those having a dynamic friction characteristic index of 1.85 or more and less than 2.50, a static friction characteristic index of 1.70 or more and less than 2.50, and a stop time index of 1.85 or more and less than 2.50 are classified.

2: For "MA", those in which one satisfying the requirements of MA1 and one satisfying the requirements of MA2 regarding the dynamic friction characteristic index, the static friction characteristic index, and the stop time index coexist are classified.

3: For "MB", those corresponding to any one of (i) to (ii) are classified.

(i) Those having a dynamic friction characteristic index of 0.50 or more and less than 1.30, a static friction characteristic index of 0.50 or more and less than 1.25, and a stop time index of 0.50 or more and less than 1.45.

(ii) Those in which one or two indices among the three indices of the dynamic friction characteristic index, the static friction characteristic index, and the stop time index fall within the range of (i), and the residual index or indices fall within the range of MA1 or MA2.

With respect to one in which the grade of the clutch friction characteristics is MB (Comparative Example 2) and those in which the lubricating oil composition does not satisfy the physicochemical properties stipulated in JASO T903:2011 (Comparative Examples 4 and 5), the evaluations (fuel saving properties and fatigue life) as mentioned later were not performed.

2-2. Fuel Saving Properties

The fuel saving properties at high speed and low speed of the lubricating oil composition were evaluated by the motoring test using a four-stroke engine of two-wheeled vehicle. The test condition is as follows.

<High Speed>

Test engine: In-line four cylinder water-cooled engine

Displacement: 599 cc

Valve system mechanism: DOHC (direct type)

Oil water temperature: 80° C.

Gearbox: Fixed at 6-speed

Rotation rate of engine: 5,000 rpm

Test oil amount: 8 L

Evaluation method: A friction torque (N·m) was measured by a dynamometer. Specifically, the lubricating oil composition was added to the aforementioned engine, and a counter shaft was driven by a motor. On that occasion, the torque applied to the counter shaft was measured, and the friction torque (N-m) was calculated from the measured value.

<Low Speed>

A friction torque (N·m) was calculated in the same manner as in the "high speed" evaluation, except for changing the rotation rate of the counter shaft to 1,500 rpm.

<Whole>

The high-speed friction torque and the low-speed friction torque were added together.

2-3. Fatigue Life

The fatigue life was measured with the following apparatus under the following condition. It is meant that the larger the 50% failure probability $L_{50}$, the more excellent the fatigue life is.

Apparatus: Radial needle bearing fatigue-evaluating tester, manufactured by Space Creation Co., Ltd.

Bearing: Manufactured by NTN Corporation (outer race ϕ32, inner race ϕ25)

Load: 4,000 N

Temperature: 120° C.

Rotation speed: 7,500 rpm

Number of measurements: 5 times

Test oil amount: 600 mL

Evaluation method: The time when a vibration value became twice as large as an initial value was defined as the fatigue life, the measurement results of 5 times were subjected to Weibull plotting, and the "$L_{50}$ value (the rotation number at which the cumulative damage probability reaches 50%)" was calculated from an approximate straight line thereof and evaluated.

TABLE 1

| | | | | Example 1 | Example 2 | Example 3 | Example 4 | Example 5 | Comparative Example 1 |
|---|---|---|---|---|---|---|---|---|---|
| Composition of lubricating oil composition | Base oil | Base oil (A) | Base oil 1 | — | 78.93 | 79.25 | 78.32 | 79.04 | — |
| | | | Base oil 2 | 59.22 | — | — | — | — | — |
| | | | Base oil 3 | 30.00 | 10.00 | 10.00 | 10.00 | 10.00 | — |
| | | Other base oil | Base oil 4 | — | — | — | — | — | 63.40 |
| | | | Base oil 5 | — | — | — | — | — | 25.00 |
| | Ethylene-propylene copolymer (B) | | | 1.00 | 1.00 | 0.50 | 2.00 | 1.00 | — |
| | Metal-based detergent (C) | C1 | | 1.67 | 1.67 | 1.67 | 1.67 | 1.26 | — |
| | | C2-1 | | 0.16 | 0.16 | 0.16 | 0.16 | 0.41 | — |
| | | C2-2 | | 0.60 | 0.60 | 0.60 | 0.60 | 0.60 | — |
| | Viscosity index improver (D) | Polymethacrylate 1 | | 1.95 | — | — | — | — | — |
| | | Polymethacrylate 2 | | — | 2.24 | 2.42 | 1.85 | 2.29 | — |
| | | Olefin copolymer | | — | — | — | — | — | 4.60 |
| | Pour-point depressant | | | 0.20 | 0.20 | 0.20 | 0.20 | 0.20 | 0.20 |
| | Package additive | Package A | | 5.20 | 5.20 | 5.20 | 5.20 | 5.20 | — |
| | | Package B | | — | — | — | — | — | 6.80 |
| Properties | Kinematic viscosity at 100° C. ($mm^2/s$) | | | 9.1 | 8.8 | 8.8 | 9.1 | 8.8 | 10.7 |
| | HTHS viscosity at 100° C. (mPa · s) | | | 5.5 | 5.8 | 5.7 | 6.0 | 5.8 | 7.2 |
| | HTHS viscosity at 150° C. (mPa · s) | | | 2.9 | 2.9 | 2.9 | 2.9 | 2.9 | 3.1 |
| | CCS viscosity at −35° C. (mPa · s) | | | 5500 | 6000 | 5800 | 7000 | 5800 | >15000 |
| | Calcium amount derived from package B (ppm by mass) | | | — | — | — | — | — | 2300 |
| | $Ca_1$ (ppm by mass) | | | 1600 | 1600 | 1600 | 1600 | 1200 | — |
| | $Ca_2$ (ppm by mass) | | | 400 | 400 | 400 | 400 | 800 | — |
| | $Ca_1/Ca_2$ | | | 4.0 | 4.0 | 4.0 | 4.0 | 1.5 | — |
| | Sulfated ash content (% by mass) | | | 0.90 | 0.90 | 0.90 | 0.90 | 0.90 | 0.98 |
| Standard | JASO Standard | | | MA2 | MA2 | MA2 | MA2 | MA | MA2 |
| | SAE viscosity | | | 0W-20 | 0W-20 | 0W-20 | 5W-20 | 0W-20 | 10W-30 |
| Evaluation | Clutch friction characteristics | Dynamic friction characteristic index (DFI) | | 2.11 | 2.23 | 2.23 | 2.23 | 2.10 | 2.00 |
| | | Static friction characteristic index (SFI) | | 1.75 | 1.84 | 1.84 | 1.84 | 1.51 | 1.73 |
| | | Stop time index (STI) | | 2.13 | 2.21 | 2.21 | 2.21 | 2.09 | 2.04 |
| | Fuel saving properties | High speed | | 29.04 | 29.11 | 29.10 | 29.17 | 29.09 | 30.65 |
| | | Low speed | | 11.78 | 11.89 | 12.22 | 11.30 | 11.90 | 12.50 |
| | | Whole | | 40.82 | 41.00 | 41.32 | 40.47 | 40.99 | 43.15 |
| | Fatigue life ($\times 10^6$ rotations) | | | 14.64 | 14.46 | 14.43 | 14.86 | 14.47 | 14.43 |

| | | | | Comparative Example 2 | Comparative Example 3 | Comparative Example 4 | Comparative Example 5 |
|---|---|---|---|---|---|---|---|
| Composition of lubricating oil composition | Base oil | Base oil (A) | Base oil 1 | 78.95 | 89.35 | 89.88 | 90.05 |
| | | | Base oil 2 | — | — | — | — |
| | | | Base oil 3 | 10.00 | — | — | — |
| | | Other base oil | Base oil 4 | — | — | — | — |
| | | | Base oil 5 | — | — | — | — |
| | Ethylene-propylene copolymer (B) | | | 1.00 | — | — | 1.00 |
| | Metal-based detergent (C) | C1 | | 0.85 | 1.67 | 1.67 | 1.67 |
| | | C2-1 | | 0.65 | 0.16 | 0.16 | 0.16 |

TABLE 1-continued

| | | | | | | |
|---|---|---|---|---|---|---|
| | | C2-2 | 0.60 | 0.60 | 0.60 | 0.60 |
| | Viscosity index improver (D) | Polymethacrylate 1 | — | — | — | — |
| | | Polymethacrylate 2 | 2.55 | 2.82 | 2.29 | 1.12 |
| | | Olefin copolymer | — | — | — | — |
| | Pour-point depressant | | 0.20 | 0.20 | 0.20 | 0.20 |
| | Package additive | Package A | 5.20 | 5.20 | 5.20 | 5.20 |
| | | Package B | — | — | — | — |
| Properties | Kinematic viscosity at 100° C. ($mm^2/s$) | | 8.8 | 8.8 | 8.2 | 7.5 |
| | HTHS viscosity at 100° C. (mPa · s) | | 5.8 | 5.7 | 5.2 | 4.8 |
| | HTHS viscosity at 150° C. (mPa · s) | | 2.9 | 2.9 | 2.6 | 2.3 |
| | CCS viscosity at −35° C. (mPa · s) | | 5800 | 5500 | 5500 | 5000 |
| | Calcium amount derived from package B (ppm by mass) | | — | — | — | — |
| | $Ca_1$ (ppm by mass) | | 800 | 1600 | 1600 | 1600 |
| | $Ca_2$ (ppm by mass) | | 1200 | 400 | 400 | 400 |
| | $Ca_1/Ca_2$ | | 0.7 | 4.0 | 4.0 | 4.0 |
| | Sulfated ash content (% by mass) | | 0.90 | 0.90 | 0.90 | 0.90 |
| Standard | JASO Standard | | MB | MA2 | Nonstandard [a)] | Nonstandard [a)] |
| | SAE viscosity | | 0W-20 | 0W-20 | 0W-20 | 0W-16 |
| Evaluation | Clutch friction characteristics | Dynamic friction characteristic index (DFI) | 2.07 | 2.23 | — | — |
| | | Static friction characteristic index (SFI) | 1.24 | 1.84 | — | — |
| | | Stop time index (STI) | 2.07 | 2.21 | — | — |
| | Fuel saving properties | High speed | — | 29.47 | — | — |
| | | Low speed | — | 12.87 | — | — |
| | | Whole | — | 42.34 | — | — |
| | Fatigue life ($\times 10^6$ rotations) | | — | 13.30 | — | — |

[a)] The physicochemical properties stipulated in JASO T903 are not satisfied.

In Table 1, the used materials and so on are as follows.

<Base Oil (A)>

Base oil 1: Mineral oil classified into Group 3 of the API Base Oil Categories, having a kinematic viscosity at 100° C. of 4.22 $mm^2/s$ and a viscosity index of 122

Base oil 2: Mineral oil classified into Group 3 of the API Base Oil Categories, having a kinematic viscosity at 100° C. of 4.15 $mm^2/s$ and a viscosity index of 126

Base oil 3: Mineral oil classified into Group 3 of the API Base Oil Categories, having a kinematic viscosity at 100° C. of 5.88 $mm^2/s$ and a viscosity index of 130

<Other Base Oil>

Base oil 4: Mineral oil classified into Group 2 of the API Base Oil Categories, having a kinematic viscosity at 100° C. of 5.25 $mm^2/s$ and a viscosity index of 115

Base oil 5: Mineral oil classified into Group 2 of the API Base Oil Categories, having a kinematic viscosity at 100° C. of 10.50 $mm^2/s$ and a viscosity index of 97

<Ethylene-Propylene Copolymer (B)>

Ethylene-propylene copolymer having a mass average molecular weight of 14,000 and a kinematic viscosity at 100° C. of 2,000 $mm^2/s$ <Calcium Phenate (C1)>

C1 (Overbased calcium phenate having a total base number of 263 mgKOH/g and a calcium content of 9.6% by mass)

<Calcium Sulfonate (C2)>

C2-1 (Overbased calcium sulfonate having a total base number of 425 mgKOH/g and a calcium content of 16.1% by mass)

C2-2 (Neutral calcium sulfonate having a total base number of 16 mgKOH/g and a calcium content of 2.4% by mass)

<Viscosity Index Improver (D)>

Polymethacrylate 1 (mass average molecular weight: 400,000)

Polymethacrylate 2 (mass average molecular weight: 230,000)

Olefin copolymer (mass average molecular weight: 580,000)

<Pour-Point Depressant>

Polymethacrylate 3 (mass average molecular weight: 69,000)

<Package A>

Additive package containing a zinc dialkyldithiophosphate, an amine-based antioxidant, and an imide-based dispersant (phosphorus content: 1.02% by mass, zinc content: 1.15% by mass, nitrogen content: 1.02% by mass)

<Package B>

Additive package containing a zinc dialkyldithiophosphate, an amine-based antioxidant, a calcium-based detergent, and an imide-based dispersant (phosphorus content: 1.39% by mass, zinc content: 1.54% by mass, nitrogen content: 0.85% by mass, calcium content: 3.45% by mass)

From the results of Table 1, it could be confirmed that the lubricating oil compositions for two-wheeled vehicles of Examples 1 to 5 are able to not only suppress a lowering of fatigue life of engine parts while making fuel saving properties (in particular, fuel saving properties at the time of low speed) favorable but also make clutch friction characteristics of two-wheeled vehicles favorable.

The lubricating oil composition of Comparative Example 1 has a wholly high viscosity and does not contain the ethylene-propylene copolymer (B), and therefore, though it was favorable in terms of clutch friction characteristics and fatigue life, it could not be satisfied with the fuel saving properties.

Though the lubricating oil composition of Comparative Example 2 contains the base oil (A) having a viscosity index of 120 or more, the ethylene-propylene copolymer (B), and the metal-based detergent (C), respectively, its $Ca_1/Ca_2$ was less than 1.0, and therefore, it could not be satisfied with the clutch friction characteristics.

The lubricating oil composition of Comparative Example 3 does not contain the ethylene-propylene copolymer (B), and therefore, it could not form an appropriate oil film (in particular, an appropriate oil film could not be formed at the time of low speed) and could not be satisfied with fatigue life and the fuel saving properties.

The lubricating oil composition of Comparative Example 4 does not contain the ethylene-propylene copolymer (B), and its HTHS viscosity at 150° C. is low; and therefore, it could not be satisfied with the physicochemical properties stipulated in JASO T903. For this reason, an appropriate oil film cannot be formed.

Though the lubricating oil composition of Comparative Example 5 contains the base oil (A) having a viscosity index of 120 or more, the ethylene-propylene copolymer (B), and the metal-based detergent (C), respectively, its HTHS viscosity at 150° C. is extremely low, and therefore, it could not be satisfied with the physicochemical properties stipulated in JASO T903. For this reason, an appropriate oil film cannot be formed.

The invention claimed is:

1. A lubricating oil composition, comprising a base oil (A) having a viscosity index of 120 or more, an ethylene-propylene copolymer (B) having a mass average molecular weight of 30,000 or less, a metal-based detergent (C), and a viscosity index improver (D) having a mass average molecular weight of 100,000 or more, wherein the content of the ethylene-propylene copolymer (B) is 0.30% by mass or more on the basis of the whole amount of the lubricating oil composition;

the metal-based detergent (C) contains a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is satisfied with a relation of ($1.0 \leq Ca_1/Ca_2$); and the lubricating oil composition has a kinematic viscosity at 100° C. of less than 9.3 $mm^2/s$ and an HTHS viscosity at 150° C. of 2.9 mPa·s or more.

2. The lubricating oil composition according to claim 1, wherein a kinematic viscosity at 100° C. of the ethylene-propylene copolymer (B) is 750 $mm^2/s$ or more and 2,500 $mm^2/s$ or less.

3. The lubricating oil composition according to claim 1, wherein the content of the metal-based detergent (C) as expressed in terms of a metal atom is more than 0.12% by mass and 0.22% by mass or less on the basis of the whole amount of the lubricating oil composition.

4. The lubricating oil composition according to claim 1, wherein the content ($Ca_1$) of the calcium phenate (C1) as expressed in terms of a calcium atom is 0.10% by mass or more and 0.20% by mass or less on the basis of the whole amount of the lubricating oil composition.

5. The lubricating oil composition according to claim 1, wherein the viscosity index improver (D) is a poly(meth) acrylate-based viscosity index improver.

6. The lubricating oil composition according to claim 1, wherein the sulfated ash content of the lubricating oil composition is 0.9% by mass or less.

7. The lubricating oil composition according to claim 1, wherein the viscosity grade of the lubricating oil composition is xW-20 to xW-8 in terms of the classification according to SAE J300:2015, and x is 0, 5, or 10.

8. The lubricating oil composition according to claim 1, which is useful for engines.

9. A method for improving fuel consumption of two-wheeled vehicles, comprising adding the lubricating oil composition according to claim 1 to a two-wheeled vehicle engine.

10. The lubricating oil composition according to claim 1, wherein a content of the viscosity index improver (D) is 90 parts by mass or more and 500 parts by mass or less with respect to 100 parts by mass of the ethylene-propylene copolymer (B).

11. The lubricating oil composition according to claim 1, wherein a content of the viscosity index improver (D) is 150 parts by mass or more and 250 parts by mass or less with respect to 100 parts by mass of the ethylene-propylene copolymer (B).

12. The lubricating oil composition according to claim 1, wherein the ethylene-propylene copolymer (B) has a mass average molecular weight of 11,000 or more and 20,000 or less.

13. The lubricating oil composition according to claim 1, wherein the viscosity index improver (D) has a mass average molecular weight of 200,000 or more and 400,000 or less.

14. A method of producing a lubricating oil composition, comprising a step of preparing a lubricating oil composition containing a base oil (A) having a viscosity index of 120 or more, an ethylene-propylene copolymer (B) having a mass average molecular weight of 30,000 or less, a metal-based detergent (C), and a viscosity index improver (D) having a mass average molecular weight of 100,000 or more, wherein the preparation is performed so as to satisfy the following requirements (i) to (iv):

(i) the content of the ethylene-propylene copolymer (B) is 0.30% by mass or more on the basis of the whole amount of the lubricating oil composition;

(ii) the metal-based detergent (C) contains a calcium phenate (C1) and a calcium sulfonate (C2), and a mass ratio of the content ($Ca_1$) of the calcium phenate (C1) as expressed in terms of a calcium atom to the content ($Ca_2$) of the calcium sulfonate (C2) as expressed in terms of a calcium atom is ($1.0 \leq Ca_1/Ca_2$);

(iii) a kinematic viscosity at 100° C. of the lubricating oil composition is less than 9.3 $rnm^2/s$; and (iv) an HTHS viscosity at 150° C. of the lubricating oil composition is 2.9 mPa·s or more.

15. The method according to claim 14, wherein a content of the viscosity index improver (D) is 90 parts by mass or more and 500 parts by mass or less with respect to 100 parts by mass of the ethylene-propylene copolymer (B).

16. The method according to claim 14, wherein a content of the viscosity index improver (D) is 150 parts by mass or more and 250 parts by mass or less with respect to 100 parts by mass of the ethylene-propylene copolymer (B).

17. The method according to claim 14, wherein the ethylene-propylene copolymer (B) has a mass average molecular weight of 11,000 or more and 20,000 or less.

18. The method according to claim 14, wherein the viscosity index improver (D) has a mass average molecular weight of 200,000 or more and 400,000 or less.

* * * * *